US009358564B2

(12) United States Patent
Deshler

(10) Patent No.: US 9,358,564 B2
(45) Date of Patent: Jun. 7, 2016

(54) PAINTING STAND FOR VEHICLE BODY PANELS

(76) Inventor: Donald T. Deshler, Orange, CA (US)

( * ) Notice: Subject to any disclaimer, the term of this patent is extended or adjusted under 35 U.S.C. 154(b) by 1280 days.

(21) Appl. No.: 13/065,544

(22) Filed: Mar. 23, 2011

(65) Prior Publication Data

US 2012/0240849 A1 Sep. 27, 2012

(51) Int. Cl.
*B05C 13/02* (2006.01)
*B05B 13/02* (2006.01)

(52) U.S. Cl.
CPC ..... *B05B 13/0285* (2013.01); *B05C 13/02* (2013.01)

(58) Field of Classification Search
None
See application file for complete search history.

(56) References Cited

U.S. PATENT DOCUMENTS

| | | | | |
|---|---|---|---|---|
| 4,029,308 | A * | 6/1977 | Mathers | 269/17 |
| 4,577,819 | A * | 3/1986 | Bennett | F16M 11/04 248/123.11 |
| 5,598,788 | A * | 2/1997 | Jonker | A47B 9/10 108/147 |
| 5,915,742 | A * | 6/1999 | Hung | 29/281.5 |
| 7,225,933 | B1 * | 6/2007 | Pollock et al. | 211/18 |
| 7,448,606 | B1 * | 11/2008 | Johnson | 269/17 |
| 2009/0184217 | A1 * | 7/2009 | Sprout | 248/124.1 |

* cited by examiner

*Primary Examiner* — Charles Capozzi
(74) *Attorney, Agent, or Firm* — Roy A. Ekstrand

(57) ABSTRACT

A painting stand for supporting vehicle body panels during the painting operation includes a base moveable upon a plurality of rolling casters and having a vertically extending upright member which in turn supports a generally T-shaped member. The T-shaped member is pivotally joined to the upper end of the vertical upright member and includes a plurality of horizontally disposed telescoping sliders and attachment arms. The upwardly extending portion of the T-shaped member includes a moveable sleeve supporting a further attachment arm. The attachment arms engage the vehicle body panel.

7 Claims, 6 Drawing Sheets

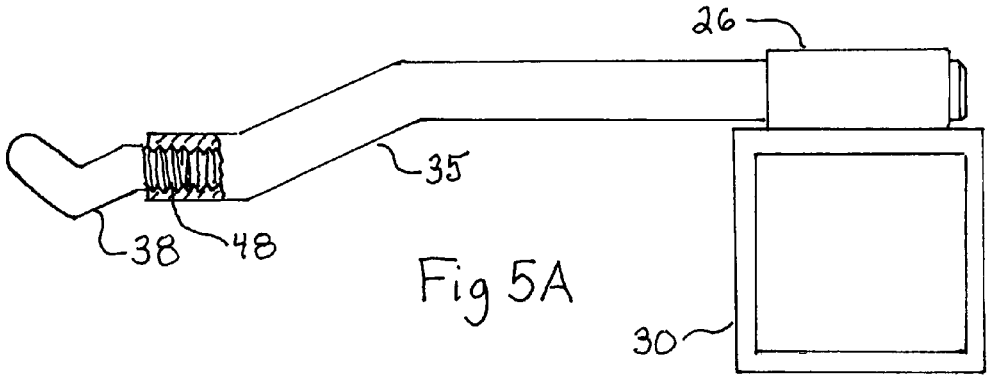
Fig 5A
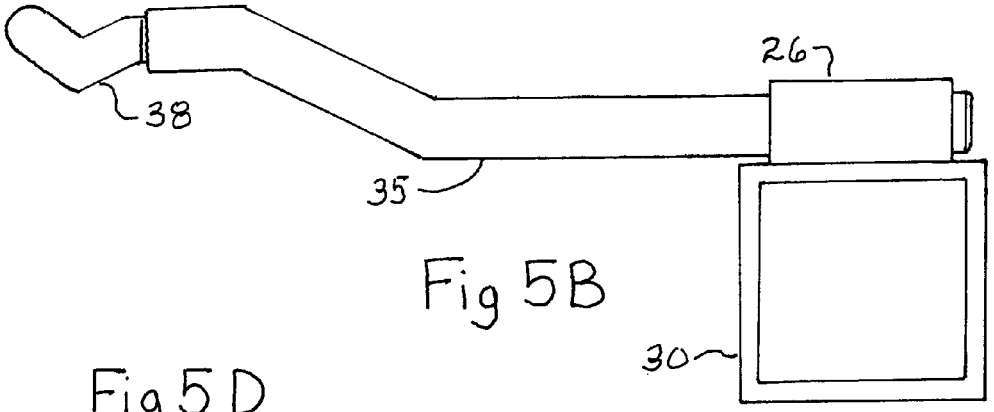
Fig 5B
Fig 5D
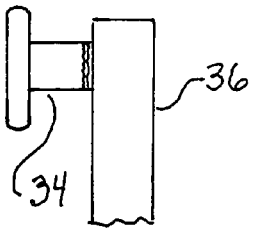
Fig 5C
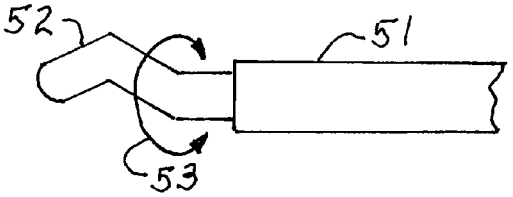
Fig 5E
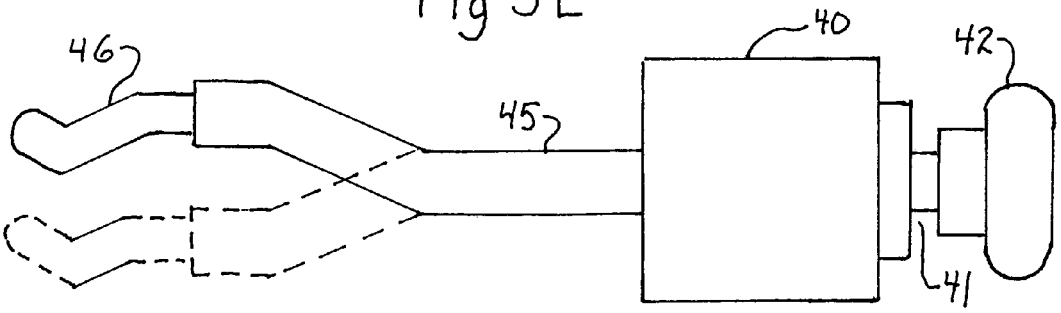

PAINTING STAND FOR VEHICLE BODY PANELS

FIELD OF THE INVENTION

This invention relates generally to vehicle body painting and repair and particularly to body panel painting stands used therein.

BACKGROUND OF THE INVENTION

Vehicle body repair and restoration often generally described as "auto body" frequently requires that body panels be painted when removed from the vehicle. In addition, for the most part, it is required that both the inside and outside surface of auto body panels be painted. In addition, it is generally advantageous that both inside and outside surfaces be painted at the same time.

In order to effectively paint both sides of auto body panels, practitioners in the automotive arts utilize various painting stands to hold and secure the body panels during the painting operation. Ideally, the goal of such painting stands is to expose both sides of the body panels utilizing a supporting structure which provides a minimum of interference or "shadowing" of the panel surface during the painting operation.

A further objective of auto body painting stands is to securely hold the panel while facilitating reorienting of the body panel into different positions as the various panel surfaces are painted. Basically, the desire is to orient body panels during the painting operation in the same general orientation as they occupy on the host vehicle. Thus for example, hoods and trunk lids which are generally horizontally positioned on the vehicle are best painted in a horizontal position. Other body panels such as doors, quarter panels and tailgates occupy generally vertical orientations upon their respective vehicles and thus are preferably painted in a generally vertical orientation. Still other body panels such as fenders include some surface portions which are horizontal and others which are vertically oriented upon their host vehicles. These panels are therefore preferably painted partially in a horizontal orientation and partially in a vertical orientation. This, of course, requires reorienting the panels during the painting operation.

The need to paint both sides of auto body panels creates the need for manipulation and reorientation of the body panels upon the painting stands during the painting operation. Unfortunately, in typical painting stands of the type provided in the existing art, such movement and orientation requires that multiple pins, clamps and clasps be manipulated and adjusted upon the paint stand support elements which in turn renders the painting process more time consuming and difficult. This increased time and difficulty typically translates to increased cost of auto painting and repair and may even result in poor quality paint finishes.

Many difficulties associated with auto body panel painting arise due to the various types of body panels which are painted when removed from the vehicle. Such off-body panels include hoods, fenders, quarter panels, trunk deck lids, doors and lift gates of the type used on pickups and sport utility vehicles. One troublesome aspect of such body panels and their support upon painting stands arises due to the substantial variation of panel size and weight. In addition, further difficulties in supporting such auto body panels during painting arise due to the non-uniform weight distribution within the panels themselves. This non-uniform weight distribution means that the body panel center of gravity is often displaced from the general center of the body panel.

Variations of size, weight and center of gravity location within auto body panels renders the support of such panels and their manipulation during the painting process to be difficult and time consuming. Despite the critical need for paint stands which securely support vehicle body panels while providing easy access to the panel surfaces and which meet practitioners needs for panel movement and reorientation during repair and painting, practitioners in the art have heretofore been largely unsuccessful in their efforts to improve automotive body panel painting stands. There arises therefore a continuing need in the art for ever more improved auto body panel painting stands.

SUMMARY OF THE INVENTION

Accordingly, it is a general object of the present invention to provide an improved painting stand for use in supporting auto body panels. It is a more particular object of the present invention to provide a painting stand for supporting auto body panels which securely supports such panels while providing access to both sides of the panels and providing ease of movement and reorientation of the panels with limited manipulation and effort.

In accordance with the present invention, there is provided for use in supporting a vehicle body panel during painting, a painting stand comprising: a base having a vertical upright member defining an upper end; a pivot bar having a top end and a bottom end; a pivot clamp pivotally securing the pivot bar to the upper end of the vertical upright member at a point on the pivot bar between the top end and the bottom end thereof and clamping the bar at a selected angle; a T-bar joined to the bottom end of the pivot bar having opposed extending T-bar ends; first and second sliders slideably received upon the T-bar ends; first and second attachment arms each having one end joined to the first and second sliders and a hook end constructed to engage a vehicle body panel; a sleeve slideably received upon the pivot bar having a third attachment arm extending therefrom, the third attachment arm having a hook end constructed to engage an auto body panel; attachment means operable upon the sleeve to fix the position of the sleeve upon and against the pivot bar; and spring bias means coupled between the pivot bar and the vertical upright member establishing a neutral angular position of the pivot bar relative to the vertical upright member and providing a spring force urging the pivot bar toward the neutral angular position when the pivot bar is pivoted.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIGS. 5A through 5E set forth partial views of the attachment arms of the present invention vehicle body panel painting stand.

DESCRIPTION OF THE PREFERRED EMBODIMENTS OF THE INVENTION

Figure 1:
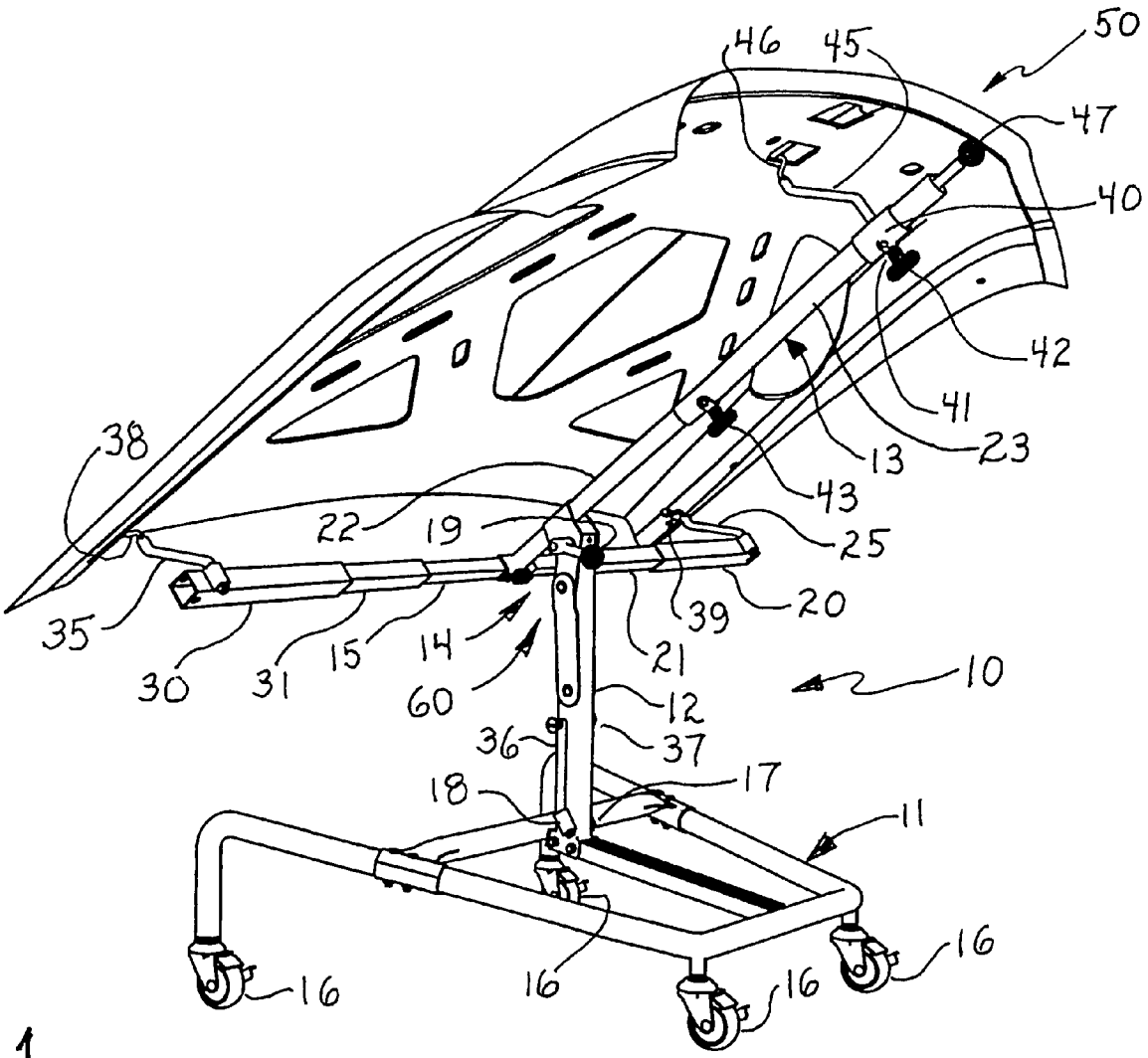
FIG. 1 sets forth a perspective view of a vehicle body panel painting stand constructed in accordance with the present invention supporting a typical body panel.

FIG. 1 sets forth a perspective view of a vehicle body panel painting stand constructed in accordance with the present invention and generally referenced by numeral 10. Painting stand 10 is shown supporting a typical vehicle body panel which, for purposes of illustration, comprises a vehicle hood 50. It will be understood that hood 50 is shown for illustration and that the present invention painting stand is to be used for virtually any hinge mounted vehicle body panel. In addition, the terms "vehicle body" and "auto body" are used interchangeably herein without limitation. Thus, auto body is used to refer to virtually any vehicle body such as automobiles, trucks, pickups, sport utility vehicles, construction vehicles and the like.

More specifically, painting stand 10 includes a base 11 having a generally trapezoidal shape and formed of rigid tubular materials such as steel or the like. Base 11 in turn supports an upwardly extending vertical upright member 12. Painting stand 10 further includes a pivot bar 13 pivotally secured to the upper end of vertical upright member 12 at a pivot clamp mechanism 14. Pivot bar 13 further supports a transversely extending T-bar 15 which in turn supports a pair of sliders 21 and 31 and a further pair of sliders 20 and 30. In the preferred fabrication of the present invention, T-bar 15, sliders 20 and 30 together with sliders 21 and 31 are formed to define a generally square cross-section. However, it will be apparent to those skilled in the art that other cross-sectional shapes for T-bar 15, sliders 20 and 21 and sliders 30 and 31 may be utilized without departing from the spirit and scope of the present invention. Within this cross-sectional shape variation, however, it has been found advantageous to utilize non-circular cross-sectional shapes such as squares, rectangles, triangles, ovals and so on to provide the performance set forth below. Sliders 21 and 31 are large enough to slide upon the extending ends of T-bar 15. Correspondingly, sliders 20 and 30 are further enlarged to facilitate sliding upon sliders 21 and 31. Slider 20 supports an attachment arm 25 having a hook 39 at the outer end thereof. Correspondingly, slider 30 supports an attachment arm 35 having a hook 38 at the extending end thereof.

Pivot bar 13 is preferably formed to two telescoping sections 22 and 23. A threaded clamp knob 43 is operative to secure the relative position of section 23 upon section 22 and thus establish the overall extended length of pivot bar 13. A sleeve 40 is slideably received upon the upper portion of section 23 of pivot bar 13 and includes a sleeve attachment 41 operated by a knob 42. In their preferred forms, attachments 42 and 43 comprise threaded apertures formed in sleeve 40 and section 23 respectively which in turn receive threaded fasteners manipulated by knobs 42 and 43. A knob 47 is supported upon the uppermost end of section 23 of pivot bar 13. Attachment arm 45 is joined to sleeve 40 in a rigid attachment and supports a hook 46 at its outer end.

A hood 50 which is of conventional fabrication and typical of a vehicle body panel defines a plurality of apertures on the interior structure thereof which are fabricated in accordance with the conventional fabrication techniques applicable to body panel fabrication. Correspondingly, hooks 38 and hooks 39 as well as hook 46 engage selected ones of the these apertures to secure hood 50 in its attachment to painting stand 10. Pivot clamp 14 includes a spring bias mechanism generally referenced by numeral 60 and is operable in the pivotal attachment and positioning of pivot bar 13 and hood 50 upon vertical upright member 12. The structure of pivot clamp 14 and spring bias mechanism 60 is set forth below in greater detail in FIGS. 3 and 6. However, suffice it to state here that pivot clamp 14 is secured at a selected pivotal position upon the upper end of vertical upright member 12 by a clamping mechanism operated by a pivot clamp handle 19. Further, the operation of spring bias mechanism 60 provides a counter balancing force upon pivot clamp 14 which urges pivot bar 13 toward a predetermined neutral angular orientation atop vertical upright member 12. This spring bias force is operated to counter balance the weight of hood 50 as the user pivots pivot bar 13 to alter the angular position of hood 50. This in turn facilitates the ease of movement of hood 50 during the painting process.

Figure 4:
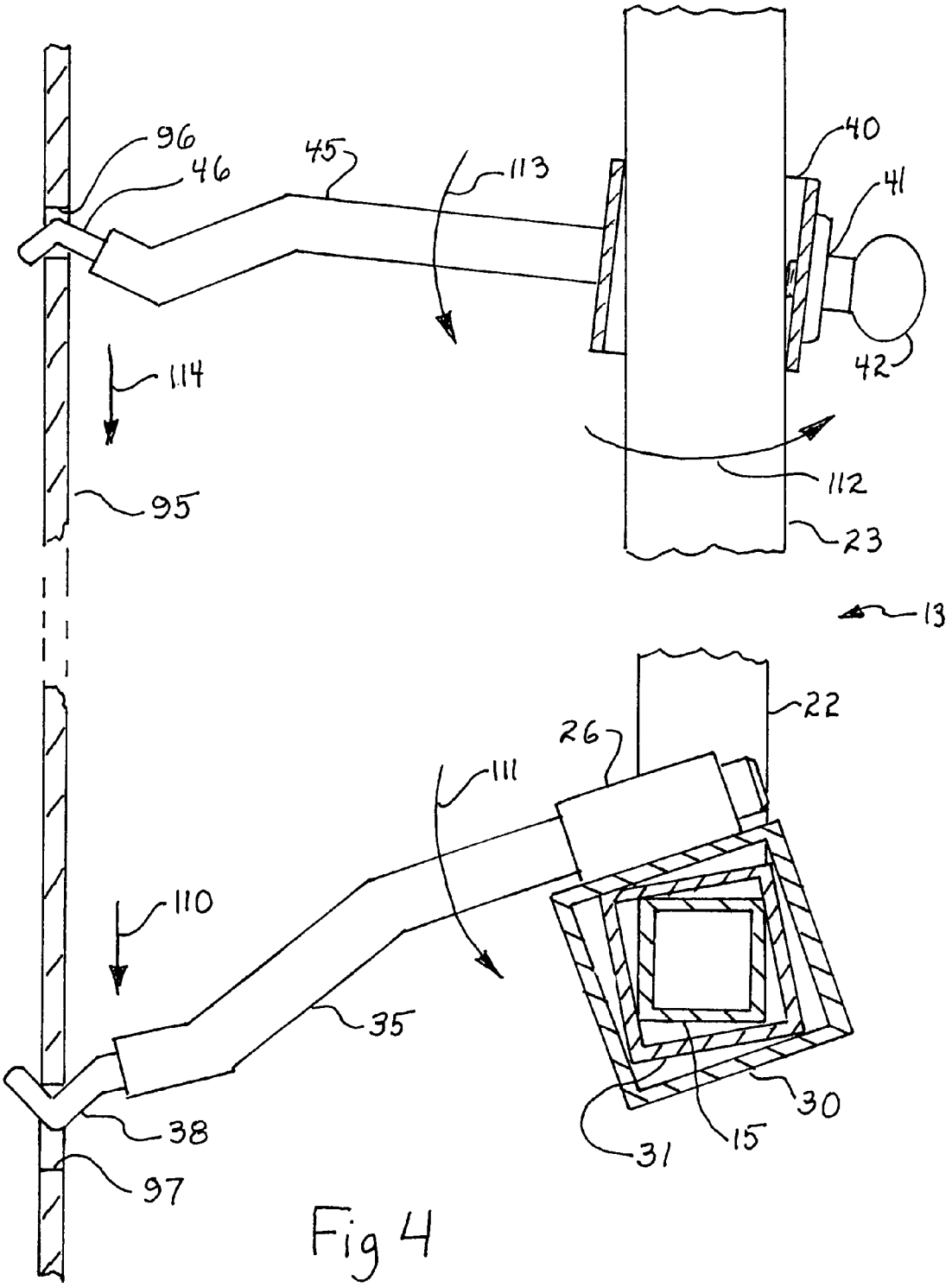
FIG. 4 sets forth a partial section view of the panel attachment supports of the present invention vehicle body panel painting stand.

In operation, and with simultaneous reference to FIG. 4, the user initially positions pivot bar 13 in a generally vertical orientation and secures pivot clamp 14. Thereafter, the user positions hood 50 in general alignment with the plane of pivot bar 13 and T-bar 15 and moves hood 50 until hooks 38 and 39 of attachment arms 35 and 25 respectively are received within selected apertures formed on the underside of hood 15. Thereafter, the user allows the weight of hood 50 to rest upon hooks 38 and 39. The user then positions sleeve 40 upon section 23 of pivot bar 13 to insert hook 46 of attachment arm 45 into a chosen aperture formed in the underside of hood 50. The user then presses sleeve 40 downwardly while sleeve attachment 41 is in a loose position allowing the angular position of attachment arm 45 to be pivoted upwardly in the manner shown in FIG. 4. The user then tightens sleeve attachment 41 using knob 42 until the position of sleeve 40 is secure upon section 23 of pivot bar 13. In accordance with several advantageous operations of painting stand 10 described below in FIG. 4 in greater detail, the tightening of sleeve attachment 41 of sleeve 40 upon pivot bar 13 provides a downward force upon attachment arm which is transmitted by hood 50 to attachment arms 25 and 35. This downward force causes sleeves 21 and 31 to be rotated slightly upon T-bar 15 and further causes sliders 20 and 30 to be rotated slightly upon sliders 21 and 31. The non-circular shape of T-bar 15 and sliders 20, 21, 30 and 31 causes the binding action described and shown in FIG. 4 to secure the positions of sliders 20, 21, 30 and 31 with respect to T-bar 15. In addition, the downward force applied by attachment arm 45 as sleeve attachment 41 is secured further secures the attachment of hood 50 to painting stand 10. In accordance with the manipulation of attachment arms 25, 35 and 45 set forth and described in FIG. 5A through 5E below, the relative position of hood 50 upon painting stand 10 may be adjusted to secure hood 50 at its best position for proper placement of the center of gravity of hood 50 and ease of handling and manipulation of hood 50 during the painting process.

Once hood 50 has been securely attached in the manner described above and further described in FIG. 4 below, the position of hood 50 supported by painting stand 10 may be easily manipulated by a single user. Thus, the angular orientation of hood 50 is changed by simply releasing pivot clamp 14, grasping knob 47 and with one hand easily pivoting hood 50 to the desired orientation. In the manner described below in FIG. 3, the pivotal movement of hood 50 is assisted by the restoring spring force of spring bias mechanism 60 making the weight of hood 50 essentially neutral at virtually all orientations ranging from vertical, to horizontal. Once the desired orientation of hood 50 has been attained, the user is able to secure such orientation by tightening clamp 14 using clamp arm 19. Clamp 14 provides an adjustable drag or braking action to damper or stop rotation as desired.

In accordance with a further advantage of the present invention painting stand, it will be noted that the present invention painting stand does not block or shadow the undersurface of hood 50. The attachment arms and T-bar 15 together with pivot bar 13 represent very small supporting structure which does not obscure the undersurface of hood 50. This provides substantial advantage over prior art structures which utilize support apparatus of substantial size and dimension and correspondingly block or shadow vast portions of the to-be-painted surface rendering the process even more difficult and costly. In accordance with a still further advantage of the present invention structure, it will be noted that vertical upright member 12 includes a pair of sockets 17 and 18 which receive attachment arms such as arms 36 and 37 in a convenient storage position. Finally, and in accordance with a still further advantage of the present invention painting stand, it will be noted that the trapezoidal shape of base 11 and the utilization of casters 16 facilitates easy movement about the shop floor. In further addition, this trapezoidal shape defined by base 11 facilitates convenient storage of painting stand 10 when not in use by allowing painting stand 10 to "nest" in stacked arrangement with additional similarly fabricated equipment such as painting stand 10 having bases similar to base 11.

Figure 2:
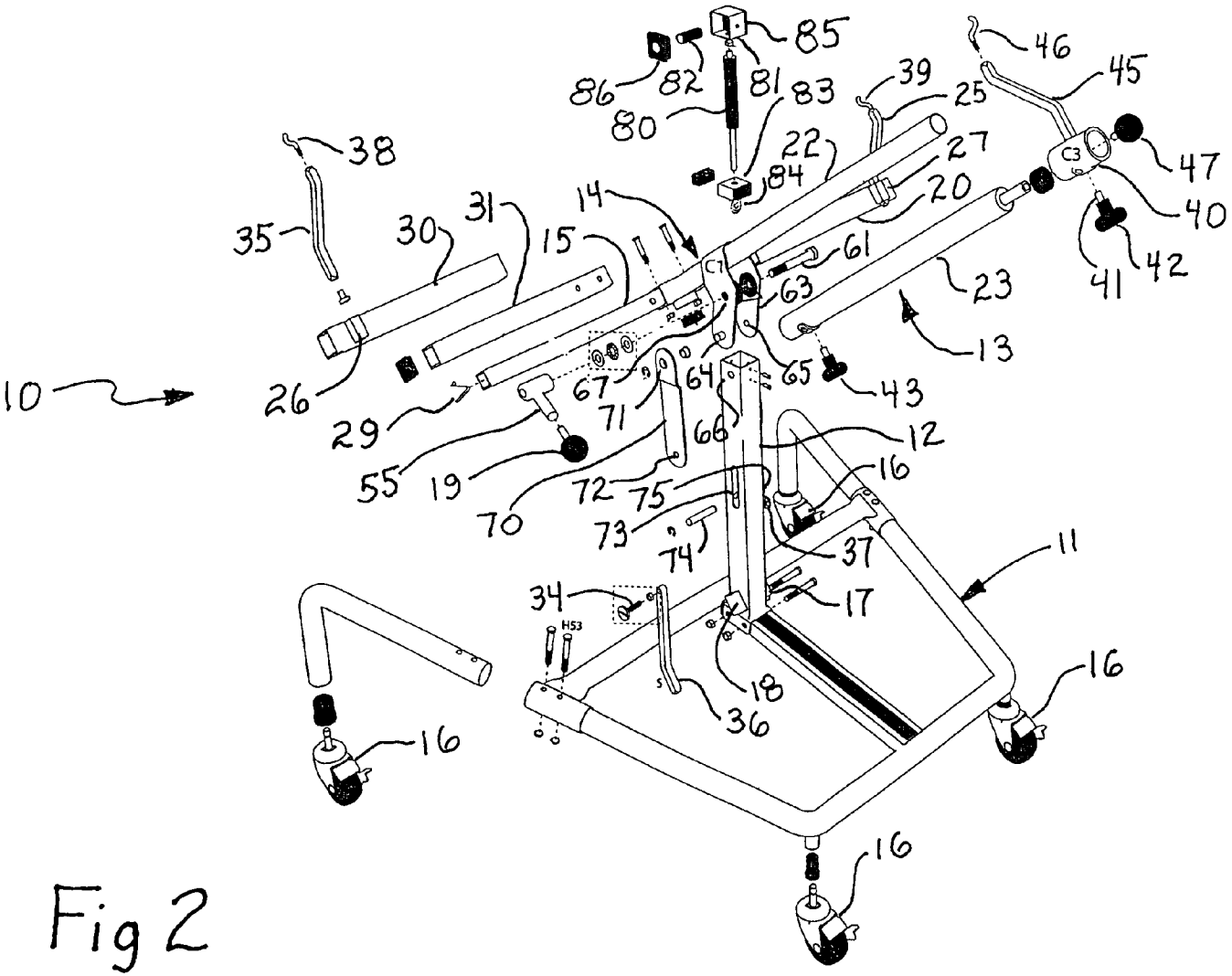
FIG. 2 sets forth a perspective assembly view of a vehicle body panel painting stand constructed in accordance with the present invention.

FIG. 2 sets forth a perspective assembly view of painting stand 10. As described above, painting stand 10 includes a base 11 supporting a vertical upright member 12 having a pivot bar 13 comprised of telescoping sections 22 and 23 together with a T-bar 15 pivotally secured to the upper portion of vertical upright member 12 by a pivotal clamp attachment 14. As is also described above, T-bar 15 receives sliders 21 and 31 which in turn receives sliders 20 and 30 in a telescoping attachment. Sliders 20 and 30 define respective sockets 27 and 26 which in turn receive attachment arms 25 and 35. As is also described above, vertical upright member 12 further supports a pair of sockets 17 and 18 which in turn receive additional attachment arms 36 and 37 in a convenient storage attachment when not in use. Attachment arms 36 and 37 are configured for an alternative attachment utilizing headed fasteners 34 and 37. Base 11 is supported by a plurality of conventional casters 16 of the type which may be locked to maintain position or, alternatively, freed to allow rolling of base 11 upon the shop floor surface as desired.

As described above, sliders 21 and 31 are slideable upon T-bar 15 to facilitate adjustment of the extension of T-bar 15 and sliders 21 and 31. Correspondingly, sliders 20 and 30 are slideable upon sliders 21 and 31 to further extend or contract the extension which supports attachment bars 25 and 35. As is also described above, attachment arms 25 and 35 further support hooks 39 and 38 respectively which are utilized in engaging a selected aperture within the body panel being supported by painting stand 10.

In further accordance with the present invention, painting stand 10 includes a spring bias mechanism which includes pivot arms 62 and 63 joined to and extending downwardly from section 22 of pivot bar 13. Arms 62 and 63 support outwardly extending pivot posts 64 and 65 respectively. Spring bias mechanism 60 further includes a pair of pivot links 70 and 75 (pivot link 75 obscured by vertical upright member 12) which are substantially identical mirror image constructions. Thus, pivot link 75 is substantially the same as pivot link 70 but oppositely positioned upon pivot arm 63. Pivot link 70 includes an aperture 71 at one end and an aperture 72 at its lower end. Correspondingly, vertical upright member 12 also defines an aperture 66 extending through the walls of upright member 12 and receiving a pivot bolt 61. Pivot arms 62 and 63 are received upon opposite sides of the upper end of vertical upright member 12 such that aperture 67 formed in arms 62 and 63 is aligned with aperture 66 formed in vertical upright member 12. Pivot links 70 and 75 are positioned such that aperture 71 of pivot link 70 and the corresponding aperture (not shown) of link 75 is also aligned with apertures 67 in arms 62 and 63. The fabrication of pivot clamp 14 is set forth below in FIG. 6 in greater detail. However, suffice it to note here that pivot bolt 61 is passed through the aligned apertures in vertical upright member 12, pivot arms 62 and 63, and pivot links 71 to form the pivotal attachment therebetween. Thereafter, pivot clamp arm 55 having knob 19 thereon receives the threaded end of pivot bolt 61 to provide completion of the pivotal attachment for pivot clamp 14.

Vertical upright member 12 further defines a pair of slots such as slot 73 on opposite sides of vertical upright member 12. A gas spring 80 includes a spring block 81 supporting a pair of bearing carriers 85 and 86 together with a bearing 82 secured to the upper end of gas spring 80. The lower end of gas spring 80 includes a spring bearing 83 supporting a downwardly extending pivot pin tab 84. Spring bearing 83 is secured to the moving end of gas spring 80. The combined structure of gas spring 80, spring block 81, bearing carriers 85 and 86 together with bearing 82 and spring bearing 83 is received within the interior of vertical upright member 12 such that bearing 82 and the apertures within spring block 81 are aligned with apertures 66 of vertical upright member 12. Additionally, gas spring 80 extends downwardly within vertical upright member 12 such that spring bearing 83 and tab 84 are aligned with slot 73 formed in vertical upright member 12. A pin 74 extends through slot 73 and the aperture formed in tab 84 to provide a movable attachment for spring bearing 83 within the interior of vertical upright member 12. Spring bearing 83 maintains the center position of gas spring 80 within vertical upright member 12. Pivot links 70 and 75 are pivotally secured to pin 74 and captivated thereon by conventional spring clips.

Figure 3:
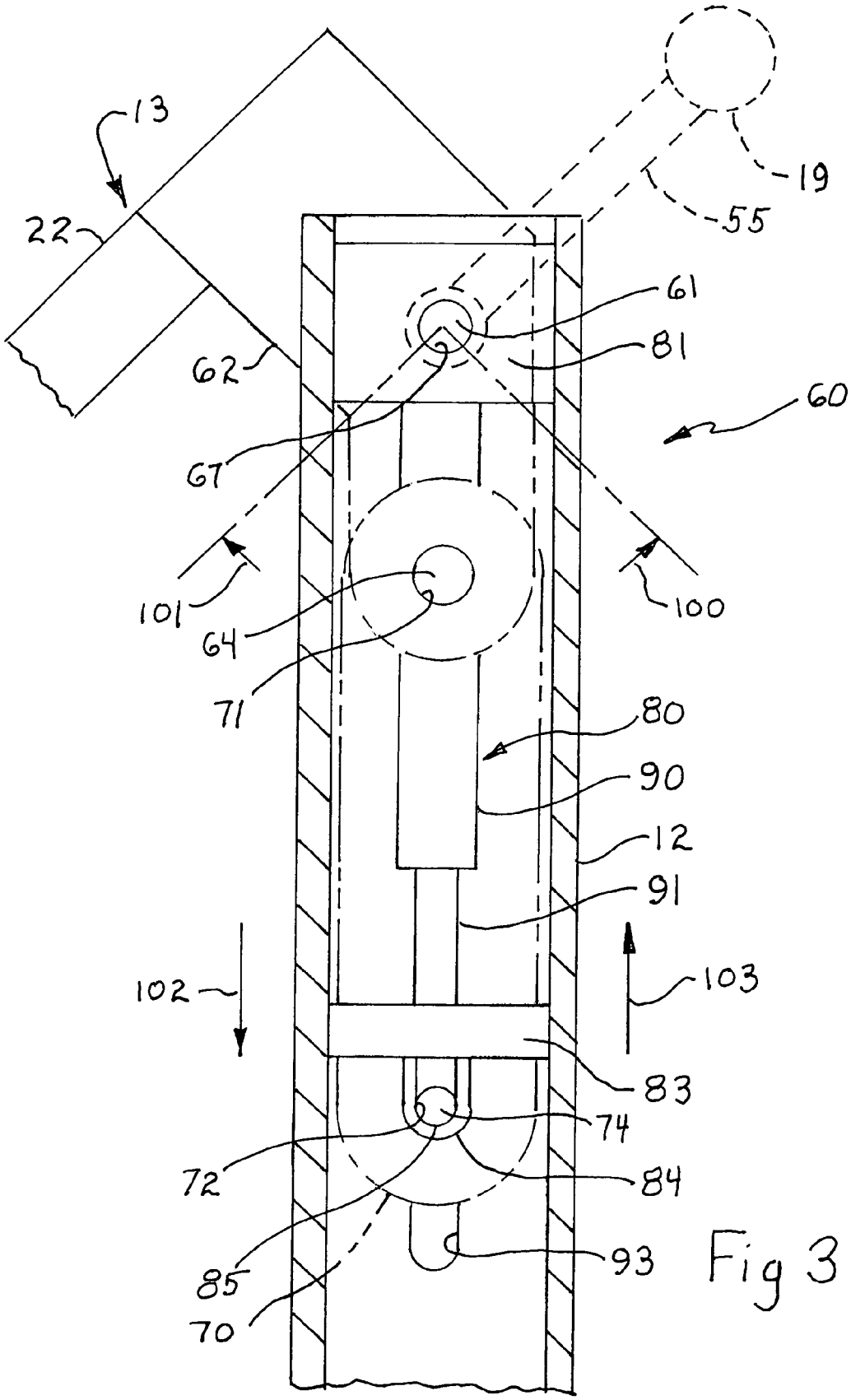
FIG. 3 sets forth a partial section view of the weight balancing pivot mechanism of the present invention vehicle body panel painting stand.

FIG. 3 sets forth a partial section view of spring bias mechanism 60. Vertical upright member 12 defines an aperture 66 in the upper end thereof (seen in FIG. 2) which receives a pivot bolt 61. A pair of pivot arms 62 and 63 (arm 63 seen in FIG. 2) extend downwardly from attachment to section 22 of pivot bar 13. The attachment of arms 62 and 63 is preferably obtained by conventional welding or other suitable attachment. Pivot arms 62 and 63 define respective apertures 67 and 77 (aperture 77 seen in FIG. 6). Apertures 67 and 77 also receive pivot bolt 61 which passes through apertures 66 formed in the upper end of vertical upright member 12. In the position shown in FIG. 3, pivot bar 13 is positioned in its neutral orientation such that the lower portion of arms 62 and 63 extend downwardly in a generally parallel relationship to vertical upright member 12. As is better seen in FIG. 6, the bottom ends of arms 62 and 63 define respective outwardly extending posts 64 and 65. As is also better seen in FIG. 6, posts 64 and 65 receive the upper ends of links 70 and 75 in a pivotal attachment. For purposes of illustration in FIG. 3, the outline of arm 62 and link 70 are shown in phantom representation to facilitate the illustration of the gas spring and associated components within the interior of vertical upright member 12. It will be noted that link 70 extends downwardly from its pivotal attachment to arm 62 in general alignment with vertical upright member 12. This generally vertical position of link 70 also corresponds to the neutral position of pivot bar 13 with respect to vertical upright member 12. Thus, with links 70 and 75 (seen in FIG. 6) pivotally secured to arms 62 and 63 (also seen in FIG. 6) the bottom ends of links 70 and 75 are positioned overlying slots 73 (seen in FIG. 2) and slot 93 both formed in vertical upright member 12.

In accordance with the present invention, a gas shock 60 is secured at its upper end to a spring block 81 which is positioned within the interior of vertical upright member 12. Spring block 81 is fabricated in the manner shown in FIG. 2 having bearing carriers 85 and 86 supporting a bearing 82 in the manner shown in FIG. 2. Suffice it to note here that spring block 81 is received within the interior of vertical upright member 12 and is secured therein by pivot bolt 61. In addition, the upper end of gas spring 60 is secured to spring block 81 in a fixed attachment. The stationary body portion of gas spring 60 generally referenced by numeral 90 extends downwardly from spring block 81 within the interior of vertical upright member 12. Gas spring 60 further includes a moveable piston arm 91 which, in accordance with the conventional operation of gas spring 60, is operatively coupled to the piston and cylinder apparatus within gas spring 60 (not shown). Piston arm 91 is coupled to a spring bearing 83 configured to move smoothly within the interior of vertical upright member 12 and is further coupled to a tab 84 having an aperture 85 formed therein. As mentioned above, vertical upright member 12 defines a slot 73 (seen in FIG. 2) and an opposed slot 93. Correspondingly, a pin 74 extends through slots 93 and 73 and further extends through aperture 85 formed in tab 84. In addition, pin 74 extends beyond slots 73 and 93 and is coupled to the lower ends of links 70 and 75 (link 75 seen in FIG. 6). With temporary reference to FIG. 2, it will be noted that link 70 defines an aperture 72 at the lower end thereof for receiving pin 74. While not seen in FIG. 3, it will be understood that the corresponding construction of link 75 also provides an aperture in the lower end thereof which receives pin 74. A pair of conventional spring clips (seen in FIG. 2) secure pin 74 within slots 73 and 93 and within the lower ends of pivot links 70 and 75.

Returning to FIG. 3, spring bias mechanism 60 is assembled within the interior of vertical upright member 12 with pivot bar 13 at approximately a forty-five degree angle to vertical upright member 12. This forty-five degree angle determines a neutral position of the spring bias provided by gas spring 80. In this neutral angular relationship, the lower ends of arms 62 and 63 are in general alignment with vertical upright member 12. Thus, in accordance with the preferred fabrication of the present invention, links 70 and 75 are sized to provide a small "preload" upon gas spring 80 when pin 74 is passed through slots 73 and 93 and engages tab 84 of spring bearing 83 and piston arm 91. This slight preload provides a small initial spring force against which spring 80 is operative. This preload results in a small downward force exerted between gas spring 80 and spring bearing 83 and tab 84 in the direction indicated by arrow 102.

In operation, with pivot bar 13 positioned in its neutral configuration shown in FIG. 3, the only spring force operative upon pin 74 is a small preload force in the direction indicated by arrow 102. Thereafter, in the event pivot bar 13 is moved from the neutral position shown in FIG. 3, such as in the direction indicated by arrow 100 the cooperation of arms 62 and 63 together with links 70 and 75 cause the lower end of gas spring 80 to be forced upwardly in the direction indicated by arrow 103. Gas spring 80 produces a spring force which resists this upward movement of spring bearing 83 and gas spring 80 is compressed. As pivot bar 13 continues to be pivoted, the upward movement upon spring bearing 83 and tab 84 causes pin 74 to be drawn upwardly within slots 73 and 93 (slot 73 seen in FIG. 2) producing an increasing spring force in the direction indicated by arrow 102. This spring force is proportional to the angular movement of pivot bar 13. Correspondingly, the spring force provided by gas spring 80 operates to balance the weight of the body panel such as hood 50 shown in FIG. 1. When the desired angular position has been obtained, the user tightens pivot clamp handle 55 upon pivot bolt 61 to provide a tightening of pivot clamp 14 by means set forth below in FIG. 6 in greater detail. Suffice it to note here that as handle 55 is turned, the clamping action applied to arms 62 and 63 secures pivot bar 13 at the desired angular position. The angular position of pivot bar 13 and correspondingly the body panel secured thereto may be further altered by loosening the clamping action of handle 55. With handle 55 loosened and the clamping action released, the force of gas spring 80 in the direction indicated by arrow 102 tends to counterbalance the weight of the body panels secured to pivot bar 13 making the pivoting of the body panel virtually effortless.

In the event pivot bar 13 is pivoted in the opposite direction as indicated by arrow 101, a corresponding action is applied to gas spring 80 moving spring bearing 83 again upwardly in the direction indicated by arrow 103 and compressing gas spring 80. Once again, gas spring 80 provides a spring force in the direction indicated by arrow 102 which tends to counterbalance the weight change of the pivotal movement of the body panel secured to pivot bar 13. Thus, with angular movement or pivoting of pivot bar 13 in either direction from its neutral forty-five degree position, gas spring 80 provides a counter balancing force which is operative through links 70 and 75 to arms 62 and 63 (seen in FIG. 2) which counter balances the weight shifting caused as the supported body panel is changed from one orientation to another. Simply stated, the spring force of gas spring 80 together with the cooperation of links 70 and 75 and arms 62 and 63 tends to compensate for pivotal movement of the body panel weight. As a result, the orientation of the body panel supported upon pivot bar 13 and T-bar 15 (seen in FIG. 1) is virtually effortless throughout the angular range of movement.

FIG. 4 sets forth a partial section view of the panel attachment mechanism operative in accordance with the present invention painting stand. Thus, as is described above, painting stand includes a T-bar 15 secured to the lower end of section 22 of pivot bar 13. As is also described above, pivot bar 13 further includes a telescoping section 23 upon which a sleeve 40 is received. Sleeve 40 further includes a sleeve attachment mechanism 41 comprising a threaded engagement of an attachment bolt received within a threaded aperture formed in sleeve 40. A knob 42 is secured to the outer end of the attachment bolt. Sleeve 40 further supports a extending attachment arm 45 having a hook 46 at the outer end thereof.

In accordance with an important aspect of the present invention, T-bar 15 further supports telescoping sliders 31 and 30 which are progressively larger and moveable upon each other and upon T-bar 15. With temporary reference to FIG. 1, it will be noted that T-bar 15 further supports a second pair of telescoping sliders 21 and 20. Returning to FIG. 4, slider 30 supports a socket 26 which receives one end of an attachment arm 35. A hook 38 is secured to the outer end of attachment arm 35. Once again to temporary reference to FIG. 1, it will be noted that a corresponding attachment arm 45 is supported upon slider 20. It will be further understood that the description which follows with respect to the cooperation of T-bar 15 and sliders 31 and 30 together with attachment arm 35 applies with equal force to the function of sliders 20 and 21 and their support of attachment arm 25.

Returning once again to FIG. 4, a body panel 95 defining apertures 96 and 97 is positioned in alignment with pivot bar 13 such that hook 38 of attachment arm 35 is received within aperture 97 of body panel 95. Thereafter, body panel 95 is rested upon hook 38 and (hook 39 seen in FIG. 1) such that the weight of body panel 95 exerts a downward force upon hook 38 in the direction indicated by arrow 110. The force exerts by the weight of body panel 95 in the direction indicated by arrow 110 produces a corresponding rotational force upon sliders 30 and 31 as well as T-bar 15 in the direction indicated by arrow 111. It will be understood that the clearances between T-bar 15 and sliders 31 and 30 is exaggerated to facilitate illustration in FIG. 4. However, in accordance with an important aspect of the present invention, it will be noted that as attachment arm 35 rotates in the direction indicated by arrow 111, the noncircular shapes of T-bar 15 and sliders 31 and 30 causes the corner portions of T-bar 15 to bind or engage the interior of slider 31. Correspondingly, the rotational force further causes the corners of sliders 31 to rotate and bind or engage the interior surfaces of slider 30. Thus, the extension of sliders 30 and 31 upon T-bar 15 is fixed due to the weight of panel 95. It will be noted that no clamps, screws or clasps of any kind are required to fix the telescoping position of sliders 30 and 31 upon T-bar 15.

With body panel 95 resting upon hooks 38 and 39 (hook 39 seen in FIG. 1) body panel 95 is position to engage hook 46 within aperture 96. Sleeve 40 is positioned upon section 23 of pivot bar 13 in the manner shown causing sleeve 40 to be slightly misaligned with section 23 of pivot bar 13. Thereafter, as the user tightens attachment 41 using knob 42, sleeve 40 is forced into proper alignment with section 23 producing a pivoting force in the direction indicated by arrow 113 as sleeve 40 pivots in the direction indicated by arrow 112. The pivotal movement of attachment arm 40 produces a downward force in the direction indicated by arrow 114 applied to body panel 95 by hook 46. As attachment 41 is fully tightened, this downward force creates a clamping force upon body panel 95. In this manner, the complete attachment of body panel 95 to the present invention painting stand is achieved. It will be noted that this full attachment is provided by simply tightening attachment 41 upon sleeve 40 with no further clamps or manipulated attachment apparatus being required. Once attachment 41 is secured, panel 95 is securely held by attachment arms 35 and 25 (seen in FIG. 1) together with attachment arm 45.

Once the painting has been completed and it is desired to remove body panel 95 from the present invention painting stand, the user simply loosens attachment 41 releasing the downward force of hook 46 upon panel 95 and facilitating the removal of body panel 95. It is important to note that in further accordance with the present invention, the loosening of attachment 41 is accomplished while body panel 95 remains resting upon hooks 38 and 39 (seen in FIG. 1) thus the body panel removal is performed by a single person and is performed without jeopardizing the support of body panel 95 during its removal.

FIGS. 5A through 5E set forth alternative attachment arms and attachment arm configurations carried forward in accordance with the present invention to provide flexibility of attachment and to illustrate the manner in which the present invention painting stand is able to facilitate a variety of attachment points for a corresponding variety of body panels.

FIG. 5A sets forth a partial section view of a typical attachment arm orientation. More specifically, slider 30 includes a socket 26 which receives one end of an attachment arm 35. Attachment arm 35 defines a threaded aperture 48 which receives the threaded end of hook 38. Of importance to note in FIG. 5A is the relationship between the position of hook 38 and slider 30 which supports attachment arm 35.

FIG. 5B sets forth an alternative position of attachment arm 35. Thus, slider 38 includes a socket 26 which receives one end of attachment arm 35. In accordance with the present invention however, attachment arm 35 is reversed in FIG. 5B and thus is angled upwardly and positions hook 38 above slider 30. Comparison of FIGS. 5A and 5B shows that the alternate positioning of attachment arm 35 within socket 26 allows the relative position of hook 38 to be changed relative to slider 30. It will also be noted that hook 38 is reversed from its position in FIG. 5A to accommodate the reversal of position of attachment arm 35.

FIG. 5C sets forth an illustration of the rotational change of hook 38. Thus, an attachment arm 51 includes a hook 52 received in a threaded attachment in the manner set forth below in FIG. 5A. It will be noted that rotation of hook 52 in the manner indicated by arrows 53 allows hook 52 to be positioned upon attachment arm 51 in an upwardly open or downwardly open or any position there between.

FIG. 5D sets forth the end portion of attachment arm 36 showing the use of a headed attachment 34 rather than the hook shown in FIGS. 5A through 5C. Headed attachment 34 is advantageous in certain body panels such as tailgates and is utilized in the same manner as described above.

FIG. 5E sets forth an illustration of the flexibility of point of attachment to be obtained by also varying the orientation of sleeve 40. Thus, as is described above, sleeve 40 includes an attachment 41 having a knob 42 secured to sleeve 40. Sleeve 40 further includes an outwardly extending attachment arm 45 having a hook 46 threaded into engagement with the outer end of attachment arm 45. FIG. 5E also shows sleeve 40 reversed from the position shown in solid line representation as the dashed line representation of attachment arm 45. As will be seen, reversing the position of sleeve 40 upon pivot bar 13 (as seen in FIG. 4) produces a corresponding reversal of attachment arm 45 to a lower position. Once again, it will be apparent that hook 46 is rotated in the dashed line position shown to accommodate proper orientation of hook 46.

Thus it will be apparent to those skilled in the art that in accordance with the present invention, the orientations of the various attachment arms utilized in securing a body panel to the present invention painting stand may be altered significantly by simply changing the orientations of the attachment arms. This is of particular importance in accommodating the various centers of gravity which are encountered in body panels.

Figure 6:
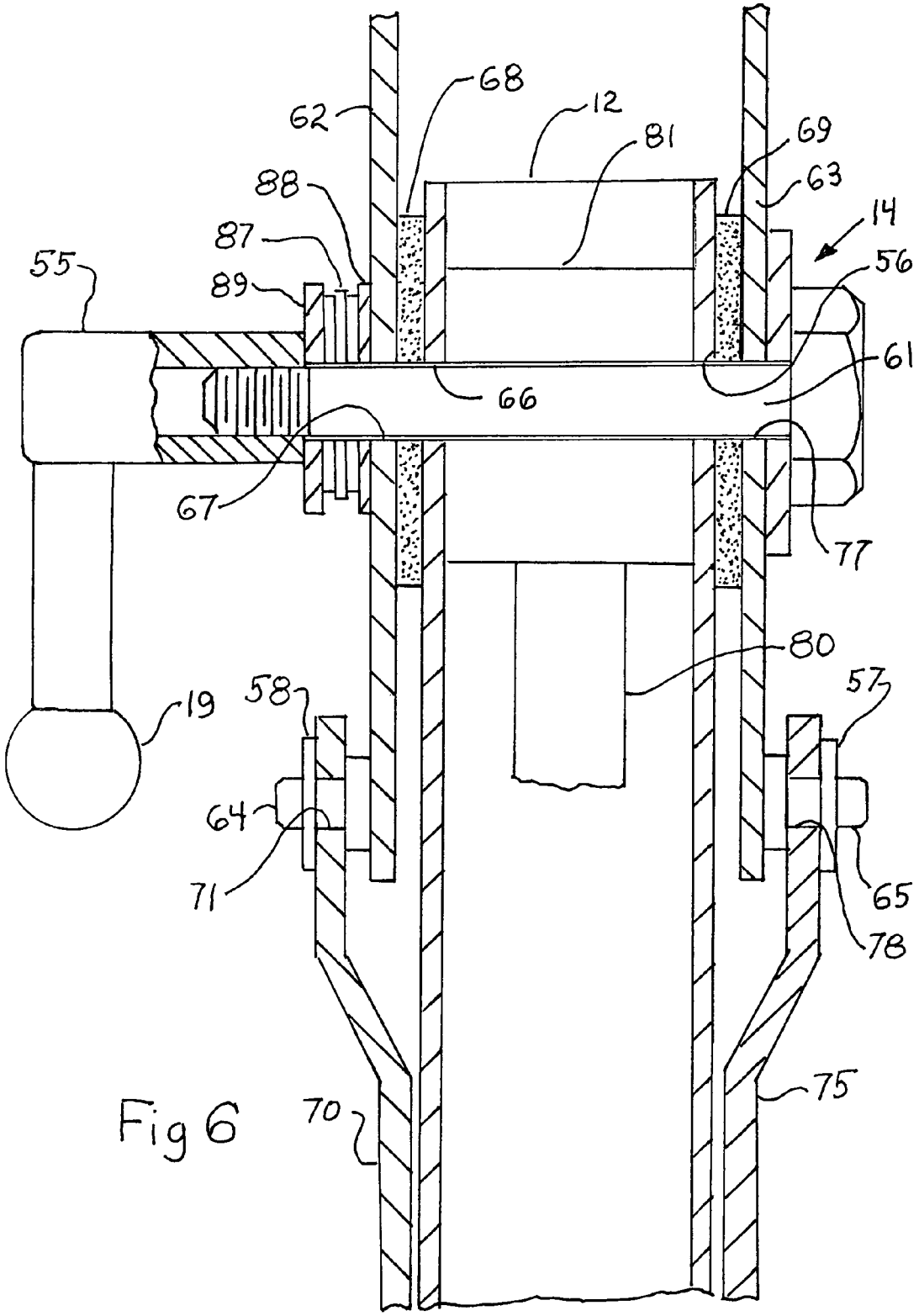
FIG. 6 sets forth a partial section view of the pivot clamp mechanism of the present invention vehicle body panel painting stand.

FIG. 6 sets forth a partial section view of pivot clamp 14. As described above, vertical upright member 12 defines a pair of aligned apertures 66 near the upper end thereof. As is also described above, arms 62 and 63 define respective apertures 67 and 77 which are aligned with apertures 66 and 56 respectively. A pivot bolt 61 extends through apertures 67 and 77 of arms 62 and 63 respectively and extends through apertures 56 and 66 formed in vertical upright member 12 to provide a pivotal attachment there between. Pivot clamp 14 further includes a pair of friction washers 68 and 69 positioned upon pivot bolt 61 and interposed between the outer surface of vertical upright member 12 and the interior surfaces of arms 62 and 63. Pivot clamp 14 further includes a thrust bearing 87 received upon pivot bolt 61 and a pair of washers 88 and 89 also received upon pivot bolt 61 on either side of bearing 87. A pivot clamp handle 55 defines an interior thread which is received upon the threaded end of pivot bolt 61. Clamp 55 further includes a knob 19. A spring block 81 is also received upon pivot bolt 81 and supports gas spring 80 in the manner set forth above in FIGS. 2 and 3.

Arms 62 and 63 extend downwardly along the outer surface of vertical upright member 12 and support a pair of outwardly extending posts 64 and 65 respectively. Links 70 and 75 define apertures 71 and 78 respectively which are received upon posts 64 and 65 respectively to provide pivotal attachment between arms 62 and 63 and links 70 and 75. A conventional clip 57 secures arm 75 upon post 65 while a corresponding conventional clip 58 secures link 70 upon post 64.

In operation, clamp 14 is loosened by rotating clamp handle 55 upon pivot bolt 61 and thereby advancing clamp handle 55 outwardly from washer 89 and bearing 87. This outward movement of clamp handle 55 relieves any pressure applied to friction washers 68 and 69. Under these conditions, arms 62 and 63 are able to pivot upon pivot bolt 61 with respect to vertical upright member 12. Once the desired angular orientation of arms 62 and 63 has been obtained, the user simply rotates clamp handle 55 to tighten clamp handle 55 against washer 89 which in turn produces a clamping force upon bearing 87 and washer 88. This compressive force in turn forces arms 62 and 63 against friction washers 68 and 69 respectively against the outer surface of vertical upright member 12. This compressive force causes friction washers 68 and 69 to prevent further rotation of arms 62 and 63. Thus, it will be apparent that the structure and operation of pivot clamp 14 provides a simple operation by which the angular position of the body panel upon the present invention painting stand is easily moved and easily secured.

What has been shown is a novel painting stand for supporting vehicle body panels during the painting operation which utilizes a slender three point attachment to the body panel exposing the body panel for easy painting and providing a minimum of interference or shadowing during the spraying operation. The apparatus shown provides adjustable mounting of the body panel to the painting stand to accommodate disparities between the general center of the body panel and the actual center of gravity. This accommodation is easily facilitated utilizing attachment arms and moveable attachments which are self securing once the body panel is secured. The inventive painting stand utilizes non-circular cross-section supporting sliders upon the simple T-bar support to engage during the clamping action and thereby secure the lower portion of the supported body panel. A gas spring operated counter balancing mechanism is operative upon the pivot portion of the present invention painting stand to provide ease of pivotal movement of the panel during the painting operation through various orientations from horizontal to vertical in range. The desired orientation is secured by tightening a single pivot clamp handle. The painting stand shown is easily stored and nested with other similarly configured painting stands to keep storage volume to a minimum and to preserve shop floor space.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in supporting a vehicle body panel during painting, a painting stand comprising:

a base having a vertical upright member defining a hollow interior passage therethrough and an upper end;

a pivot bar having a top end and a bottom end;

a pivot clamp pivotally securing said pivot bar to said upper end of said vertical upright member at a point on said pivot bar between said top end and said bottom end thereof and clamping said pivot bar at a selected angle relative to said vertical upright member;

a T-bar joined to said bottom end of said pivot bar having first and second opposed extending T-bar ends;

a pivot pin pivotally joining said pivot bar to said upper end of said vertical upright member;

first and second sliders slideably received upon said T-bar ends;

said first, second, and third hook ends cooperating to secure the vehicle body panel to said first and second sliders, and said sleeve, respectively, such that the weight of the vehicle body panel is born by said T-bar and said pivot bar a sleeve slideably received upon said pivot bar having a third attachment arm extending therefrom, said third attachment arm having a third hook end constructed to engage the vehicle body panel, said first, second and third hook ends cooperating to secure the vehicle body panel to said first, second and third sliders respectively such that the weight of the vehicle body panel is born by said T-bar and said pivot bar;

attachment means operable upon said sleeve to fix the position of said sleeve upon and against said pivot bar; and a gas spring including a spring block, a movable end, and a linkage within said hollow interior passage of said vertical upright member coupled between said pivot bar and said vertical upright member, the linkage of said gas spring coupled to said movable end of said gas spring and said pivot pin, wherein said pivot pin is disposed within said spring block, wherein said gas spring establishes a predetermined angular position of said pivot bar relative to said vertical upright member and provides a compensating spring force urging said pivot bar toward said predetermined angular position when said pivot bar is pivoted, said compensating spring force acting to compensate for the weight of the vehicle body panel during pivoting.

2. The painting stand set forth in claim 1 further including:

a third slider interposed between said first slider and said first T-bar end; and a fourth slider interposed between said second slider and said second T-bar end.

3. The painting stand set forth in claim 2 wherein said first and second T-bar ends and said first, second, third and fourth sliders each define non-circular cross sections.

4. The painting stand set forth in claim 3 wherein said cross sections are substantially rectangular.

5. The painting stand set forth in claim 4 wherein said cross sections are substantially square.

6. The painting stand set forth in claim 1 wherein said first and second sliders include respective first and second sockets and wherein said first and second attachment arms include respective first and second socket insert ends removably received within said sockets.

7. The painting stand set forth in claim 1 wherein said first and second attachment arms each include angled offset portions and wherein said first and second hook ends are reversible.

* * * * *